US009007350B2

(12) United States Patent
Burgin et al.

(10) Patent No.: US 9,007,350 B2
(45) Date of Patent: Apr. 14, 2015

(54) REDUNDANT DISPLAY ASSEMBLY

(75) Inventors: Roger W. Burgin, Scottsdale, AZ (US); Dave Pepitone, Sun City West, AZ (US); Kalluri R. Sarma, Mesa, AZ (US)

(73) Assignee: Honeywell International Inc., Morristown, NJ (US)

( * ) Notice: Subject to any disclaimer, the term of this patent is extended or adjusted under 35 U.S.C. 154(b) by 917 days.

(21) Appl. No.: 13/207,154

(22) Filed: Aug. 10, 2011

(65) Prior Publication Data

US 2013/0038584 A1 Feb. 14, 2013

(51) Int. Cl.

| | |
|---|---|
| ***G09F 11/21*** | (2006.01) |
| ***G09F 11/22*** | (2006.01) |
| ***G09F 9/30*** | (2006.01) |
| ***G09F 11/29*** | (2006.01) |
| ***G09F 21/06*** | (2006.01) |
| ***G09F 9/33*** | (2006.01) |
| ***G09F 21/04*** | (2006.01) |

(52) U.S. Cl.

CPC *G09F 9/30* (2013.01); *G09F 11/29* (2013.01); *G09F 21/06* (2013.01); *G09F 9/301* (2013.01); *G09F 9/33* (2013.01); *G09F 21/04* (2013.01)

(58) Field of Classification Search

CPC ..... G09F 9/301; G09F 21/06; G09F 11/29; G09F 9/33; G09F 11/24; G09F 11/295; G09F 11/15

USPC ..... 345/82, 205, 76; 40/446, 466, 467, 470, 40/471, 514, 584, 606.1

See application file for complete search history.

(56) References Cited

U.S. PATENT DOCUMENTS

| | | | | |
|---|---|---|---|---|
| 3,726,031 | A | 4/1973 | Singer | |
| 5,469,020 | A | 11/1995 | Herrick | |
| 6,323,832 | B1 | 11/2001 | Nishizawa et al. | |
| 6,498,597 | B1 | 12/2002 | Sawano | |
| 6,593,906 | B2 | 7/2003 | Haba | |
| 6,762,929 | B2 | 7/2004 | Sawyer | |
| 6,819,036 | B2 | 11/2004 | Cok | |
| 7,271,534 | B2 | 9/2007 | Padiyath et al. | |
| 7,426,107 | B2 | 9/2008 | Yeh et al. | |
| 7,440,265 | B2 | 10/2008 | Ou Yang | |
| 7,733,017 | B2 | 6/2010 | Shapiro et al. | |
| 7,821,479 | B2 | 10/2010 | Zhang | |
| 2002/0095836 | A1 * | 7/2002 | Segan et al. | 40/503 |
| 2004/0057830 | A1 * | 3/2004 | Boatner | 416/61 |
| 2004/0212572 | A1 | 10/2004 | Lam et al. | |
| 2006/0192729 | A1 | 8/2006 | Cantatore et al. | |
| 2008/0150885 | A1 | 6/2008 | Overwijk et al. | |

FOREIGN PATENT DOCUMENTS

| | | | |
|---|---|---|---|
| JP | 03108041 | A | 4/2003 |
| WO | 2004006217 | A1 | 1/2004 |

OTHER PUBLICATIONS

EP Search Report for application No. 12 178 567.9 dated Sep. 17, 2013.

EP Communication for application No. 12 178 567.9 dated Sep. 27. 2013.

* cited by examiner

*Primary Examiner* — Vijay Shankar

*Assistant Examiner* — Abhishek Sarma

(74) *Attorney, Agent, or Firm* — Ingrassia Fisher & Lorenz, P.C.

(57) ABSTRACT

A display assembly includes a flexible sheet. The flexible sheet is formed of a flexible material supporting a first display panel and a second display panel. A mechanism is operatively connected to the flexible sheet. The mechanism moves the flexible sheet from a first position in which said first display panel may be viewed to a second position in which said second display panel may be viewed.

20 Claims, 4 Drawing Sheets

REDUNDANT DISPLAY ASSEMBLY

TECHNICAL FIELD

The present invention generally relates to a display assembly, and more particularly relates to a display assembly for an aircraft having a built-in redundancy.

BACKGROUND

Traditionally, aircraft have utilized a large number of gauges and/or "glass" displays to monitor various aspects of flight. More recently, modern aircraft computer systems provide an increasing amount of information to the pilot(s) via a display. These displays often provide the information in a more readable and meaningful form. However, full reliance on such displays has not occurred, due to the potential failure of the display during flight. As such, modern aircraft cockpits still employ a number of gauges to provide information to the pilot, duplicating much of the information available on the display.

Accordingly, it is desirable to provide a display for a computer system that can still provide information to a user in the event of a failure of all or part of the display without reverting to standby displays or reversionary display modes. Furthermore, other desirable features and characteristics of the present invention will become apparent from the subsequent detailed description of the invention and the appended claims, taken in conjunction with the accompanying drawings and this background of the invention.

BRIEF SUMMARY

A display assembly is provided for displaying information to a user. The assembly includes a flexible sheet. The flexible sheet comprises a flexible material supporting a first display panel and a second display panel. A mechanism is operatively connected to the flexible sheet. The mechanism moves the flexible sheet from a first position in which said first display panel may be viewed to a second position in which said second display panel may be viewed.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Referring to the Figures, a display assembly 10 and associated fault-tolerant methods are shown and described herein. The display assembly 10 of the illustrated embodiment may be utilized in a vehicle (not shown), such as an aircraft (not shown), to provide visual information to an operator of the vehicle, e.g., a pilot. However, the display assembly 10 may be utilized in other implementations other than vehicles and/or aircrafts.

Figure 1:
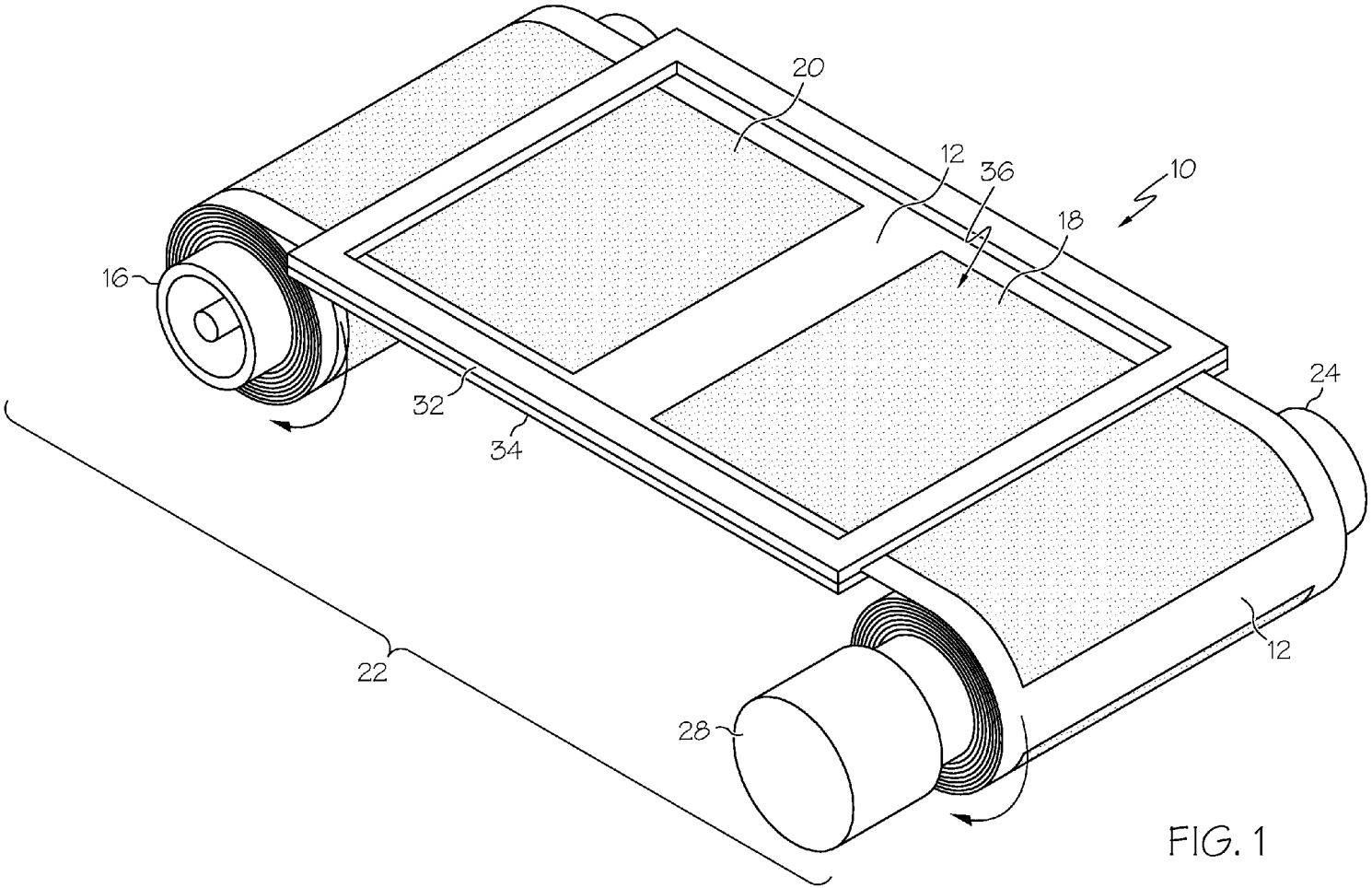
FIG. 1 is a perspective view of a display assembly with a flexible sheet and a pair of rollers.
Figure 2:
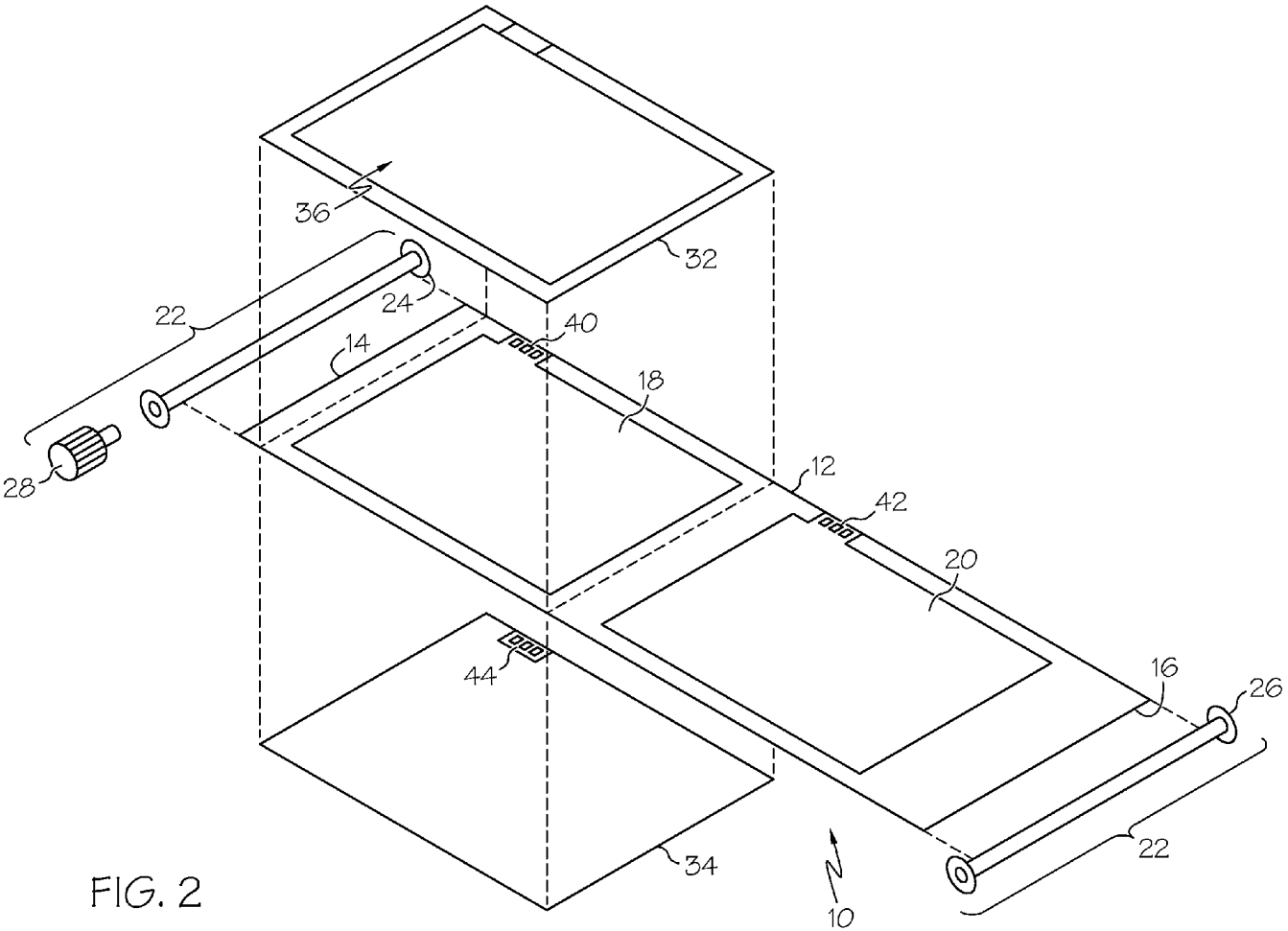
FIG. 2 is an exploded view of a display assembly showing the flexible sheet with a first display panel and a second display panel.

Referring to FIGS. 1 and 2, the display assembly 10 includes a flexible sheet 12. The flexible sheet 12 comprises a flexible material. Said another way, the flexible sheet 12 is at least partially formed of the flexible material. That is, the flexible sheet 12 may be deformed from a planar configuration without breaking. More preferably, the flexible sheet 12 may be deformed from the planar configuration without bending, warping, or binding. In one embodiment, the flexible sheet 12 comprises a flexible plastic such as polyethylene terephthalate (PET). However, other suitable flexible materials will be realized by those skilled in the art. Furthermore, the flexible sheet 12 of the illustrated embodiment may alternatively be referred to as a "roll", a "layer", or a "substrate" by those skilled in the art. The flexible sheet 12 of the illustrated embodiment is generally rectangular in shape having a first end 14 and a second end 16.

The flexible sheet 12 supports at least a first display panel 18 and a second display panel 20. As such, the flexible sheet 12 is capable of displaying information. The first display panel 18 is separate from the second display panel 20. That is, the display panels 18, 20 do not physically overlap one another. The flexible sheet 12 may further include additional display panels (not shown), e.g., a third display panel, a fourth display panel, etc. However, for ease of explanation, the embodiments described herein will be limited to the first and second display panels 18, 20.

Each display panel 18, 20 is capable of displaying information. Specifically, each display panel 18, 20 includes a plurality of light sources (not shown). In the illustrated embodiment, these light sources are light-emitting diodes (LEDs). More specifically, the light sources of the illustrated embodiment are organic light-emitting diodes (OLEDs). The flexible sheet 12 may be implemented as multiple layers (not shown) with the OLEDs disposed between the layers. In other embodiments, however, alternative suitable light sources may be implemented.

By utilizing multiple display panels 18, 20, the display assembly 10 has an extended lifespan when compared to single display systems. Particularly, certain colors of LEDs tend to dim or expire prior to other colors of LEDs. The display assembly 10 is able to swap out the active display panel 18, 20 in case of such a color loss.

The assembly 10 also includes a mechanism 22 operatively connected to the flexible sheet 12 for moving the flexible sheet 12. Specifically, the mechanism 22 moves the flexible sheet 22 from a first position, in which the first display panel 18 may be viewed, to a second position, in which the second display panel 20 may be viewed. The mechanism 22 may be actuated manually or automatically, as described in further detail below. Furthermore, the mechanism 22 may also limit movement of the flexible sheet 12 to "lock" the flexible sheet 22 in the first position, the second position, or other positions.

The mechanism 22 includes at least one roller 24, 26 operatively connected to an end 14, 16 of the flexible sheet 12. More specifically, in the illustrated embodiment, a first roller 24 is attached to the first end 14 of the flexible sheet 12 and a second roller 26 is attached to the second end 16 of the flexible sheet 12. In another embodiment (not shown), the mechanism 22 may be implemented with a single roller (not shown).

In the illustrated embodiment, by rotating one of the rollers 24, 26, the flexible sheet 12 will move, rolling onto one of the rollers 24, 26 and off of the other roller 26, 24. When the flexible sheet 12 is disposed in the first position, the second display panel 20 is substantially wrapped around the second roller 26 while the first display panel 18 is generally flat. Likewise, when the flexible sheet 12 is disposed in the second position, the first display panel 18 is substantially wrapped around the first roller 24 and the second display panel 20 is generally flat.

The mechanism 22 further includes a motor 28 operatively connected to the at least one roller 24, 26. The motor 28 rotates the at least one roller 24, 26 to facilitate movement of the flexible sheet 12 from the first position to the second position. The motor 28 is preferably capable of precise positioning, e.g., a servomotor. In other embodiments, the mechanism 22 may include a handle (not shown) operatively connected to the at least one roller 24, 26 in place of, or in addition to, the motor 28. The handle allows manual operation of the at least one roller 24, 26 in case of failure of the motor 28 or in embodiments where the motor 28 is not implemented.

The direction of movement of the flexible sheet 12 need not be one-way. For instance, the mechanism 22 may move the flexible sheet 12 from the first position to the second position and then back to the first position. This allows technicians and/or other users to inspect operation of each display panel 18, 20.

In the illustrated embodiment, the assembly 10 includes a frame 32 and a backplate 34. The frame 32 and the backplate 34 sandwich a portion of the flexible sheet 12. The frame 32 and backplate 34 assist in securing the flexible sheet 12 to prevent unwanted movement of the flexible sheet 12. The frame 32 defines a viewing area 36 through which one of the display panels 18, 20 may be viewed.

Figure 3:
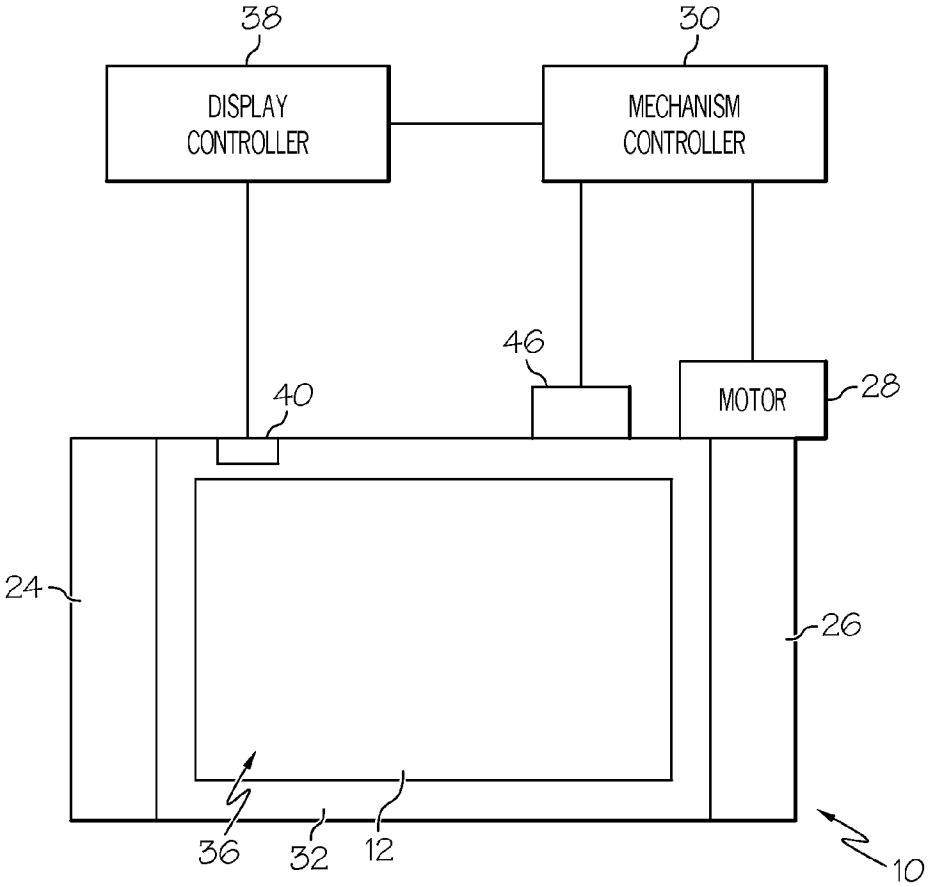
FIG. 3 is a block diagram showing electrical connections between the flexible sheet and a display controller and the rollers and a mechanism controller.

Referring now to FIG. 3, the assembly 10 of the illustrated embodiment further includes a mechanism controller 30 in communication with the mechanism 22. The mechanism controller 30 may be implemented as a microprocessor or other suitable device as realized by those skilled in the art. The mechanism controller 22 controls the mechanism 22 to automatically move the flexible sheet from the first position to the second position in response to a sensing of a malfunction in the operation of the first display panel 18. That is, when the first display panel 18 is no longer fully operational, the mechanism controller 22 moves the flexible sheet 12 such that the second display panel 20 may be viewed. As such, the display assembly 10 can continue to provide data to a viewer, e.g., the pilot of the aircraft or the driver of the vehicle, even if the first display panel 18 fails.

The assembly 10 also includes a display controller 38 electrically connected to the flexible sheet 12. The display controller 38 may be implemented as a microprocessor or other suitable device as realized by those skilled in the art. The display controller provides electrical signals to the flexible sheet 12. These electrical signals provide power to the display panels 18, 20 as well as the information (i.e., data) needed to facilitate operation of the display panels 18, 20.

In the illustrated embodiment, as shown in FIG. 3, the display controller 38 and the mechanism controller 30 are shown as separate devices. However, theses controllers 30, 38 may be integrated into a single device, as will be appreciated by those skilled in the art.

Referring again to FIG. 2, the flexible sheet 12 of the illustrated embodiment includes a first contact area 40 electrically connected to the first display panel 18 and a second contact area 42 electrically connected to the second display panel 20. The contact areas 40, 42 each provide at least one electrical contact (not shown) to allow the first display panel 18 and the second display panel 20 to receive the electrical signals from the display controller 38. In other embodiments, the flexible sheet 12 may be implemented with a single contact area (not shown) which is utilized by each of the display panels 18, 20.

The system 10 also includes at least one electrical contact 44 electrically connected to the display controller 38. The electrical contact 44 is electrically connectable to the contact areas 40, 42 of the flexible sheet 12 for supplying an electrical signal from the controller to at least one of the display panels 18, 20. In the illustrated embodiment, the at least one electrical contact 44 is disposed on the backplate 34. In another embodiment, the at least one electrical contact 44 is disposed on the frame 32 (not shown). Although the illustrated embodiment shows only one electrical contact 44, in other embodiments (not shown), a plurality of electrical contacts 44 may be disposed on the backplate 34 and/or the frame 32. The plurality of electrical contacts 44 may provide redundancy in the event of a failure of one of the electrical contacts 44.

Referring again to FIG. 3, the system 10 may include a sensor 46 for sensing a malfunction in the operation of the first display panel 18 and/or the second display panel 20. In one embodiment, the sensor 46 may comprise a current sensor for sensing electrical current being supplied to the display panels 18, 20. In another embodiment, the sensor 46 may comprise a light sensor for sensing light emitted from all of or a portion of the display panels 18, 20. In yet another embodiment, the sensor 46 may be integrated with the display controller 38. The sensor 46 is in communication with the mechanism controller 30 to trigger operation of the motor 28, and thus rotation of the rollers 24, 26, upon a fault, malfunction, and/or failure of one of the display panels 18, 20.

Figure 4:
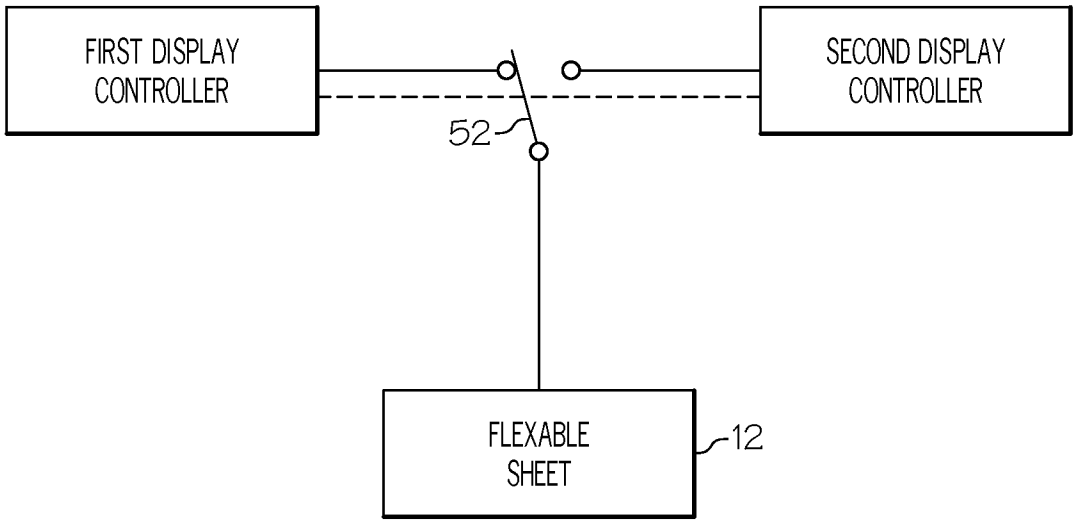
FIG. 4 is a block diagram showing electrical connections between first and second display controllers and the flexible sheet.

In an alternative embodiment, as shown in FIG. 4, the display controller 38 may be implemented as a first display controller 48 and a second display controller 50. The second display controller 50 acts as a redundant backup to the first display controller 48, or vice-versa. Each of the display controllers 48, 50 is electrically connectable to the flexible sheet 12 for supplying electrical signals to at least one of the display panels 18, 20. A switch 52 may be electrically connected between the first and second display controllers 48, 50 and the flexible sheet 12. The switch 52 is movable between a first position and a second position such that the first display controller 48 is electrically connected to the flexible sheet 12 in the first position and the second display controller 50 is electrically connected to the flexible sheet 12 in the second position. The switch 52 switches from the first position to the second position in response to detection of a fault in the first controller.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A display assembly, comprising:

a flexible sheet comprising a flexible material supporting a first display panel and a second display panel, said first display panel comprising a first plurality of light emitting diodes ("LEDs"), said second display panel comprising a second plurality of LEDs, and said second display panel configured to display an image that is substantially redundant to an image displayed by said first display panel;

a sensor that senses a malfunction of at said first display panel; and a mechanism operatively connected to said flexible sheet, said mechanism configured to move, in response to said malfunction sensed by said sensor, said flexible sheet from a first position, in which said first display panel is visible, to a second position, in which said second display panel is visible, such that said second display panel displays said image that is substantially redundant to said image displayed by said first display panel.

2. An assembly as set forth in claim 1 further comprising a mechanism controller in communication with said mechanism to automatically move said flexible sheet from said first position to said second position in response to the sensing of the malfunction.

3. An assembly as set forth in claim 1 wherein said mechanism includes at least one roller operatively connected to an end of said flexible sheet.

4. An assembly as set forth in claim 3 wherein said mechanism further includes a motor operatively connected to said at least one roller for rotating said roller to facilitate movement of said flexible sheet from the first position to the second position.

5. An assembly as set forth in claim 4 further comprising:

a current sensor for sensing an electrical current supplied to said first display panel; and a mechanism controller in communication with said current sensor, said mechanism controller receiving a signal output by said current sensor, said mechanism controller determining that one of said first plurality of LEDs in said first display panel is malfunctioning based upon said received signal.

6. An assembly as set forth in claim 5 wherein said mechanism controller is in communication with said motor and said sensor to move said flexible sheet from the first position to the second position in response to said received signal output by said current sensor.

7. An assembly as set forth in claim 6 wherein said flexible sheet includes a first contact area electrically connected to said first display panel and a second contact area electrically connected to said second display panel.

8. An assembly as set forth in claim 7 further comprising a display controller electrically connectable to at least one of said display panels for supplying electrical signals to said at least one of said display panels.

9. An assembly as set forth in claim 8 further comprising an electrical contact electrically connected to said display controller and electrically connectable to at least one of said contact areas for supplying an electrical signal from said controller to at least one of said display panels.

10. An assembly as set forth in claim 1 further comprising a frame having a viewing area through which one of said display panels may be viewed.

11. An assembly as set forth in claim 10 wherein said flexible sheet includes a first contact area electrically connected to said first display panel and a second contact area electrically connected to said second display panel.

12. An assembly as set forth in claim 11 wherein said frame includes at least one electrical contact electrically connected to said first contact area when said flexible sheet is in the first position and electrically connected to said second contact area when said flexible sheet is in the second position.

13. An assembly as set forth in claim 12 further comprising a display controller electrically connected to said electrical contacts for supplying an electrical signal to at least one of said display panels.

14. An assembly as set forth in claim 1 further comprising a first display controller and a second display controller each electrically connectable to said flexible sheet for supplying an electrical signals to at least one of said display panels, said first display controller comprising a redundant backup to the second display controller.

15. An assembly as set forth in claim 14 further comprising a switch that is configured to couple said second display controller to said flexible sheet in response to the detection of a fault in said first display controller, such that said first display panel is coupled to said second display controller as a redundant display controller.

16. An assembly as set forth in claim 15 wherein said switch switches from a first position to a second position in response to detection of the fault in said first controller.

17. An assembly as set forth in claim 1 wherein said mechanism includes a first roller operatively connected to a first end of said flexible sheet and a second roller operatively connected to a second end of said flexible sheet opposite said first end.

18. An assembly as set forth in claim 1 wherein each of said first plurality of LEDs and second plurality of LEDs comprise organic light emitting diodes (OLEDs).

19. A display assembly, comprising:

a flexible sheet comprising a flexible material supporting a first display panel and a second display panel;

a first display controller and a second display controller, each of said first display controller and said second display controller electrically connectable to said display panels for supplying electrical signals to said display panels, said second display controller redundant to said first display controller;

a switch configured to couple said second display controller to either of said first display panel or said second display panel in response to detection of an occurrence of a fault in said first display controller; and a mechanism operatively connected to said flexible sheet for moving said flexible sheet from a first position, in which said first display panel may be viewed, to a second position, in which said second display panel may be viewed.

20. A display assembly, comprising:

a flexible sheet comprising a flexible material supporting a first display panel and a second display panel; and a mechanism operatively connected to said flexible sheet for moving said flexible sheet from a first position, in which said first display panel is visible, to a second position, in which said second display panel is visible;

a first sensor for sensing a malfunction of a light emitting diode ("LED") comprising said first display panel;

a first display controller configured to be coupled to either of said first display panel or said second display panel;

a second display controller configured to be coupled to either of said first display panel or said second display panel;

a second sensor for sensing an occurrence of a fault in said first display panel;

a mechanism controller in communication with said mechanism and said first sensor, said mechanism controller receiving a signal output by said first sensor indicating said LED malfunction, said mechanism controller configured to move said flexible sheet from said first position to said second position in response to the receiving the signal; and a switch coupled between said first display controller, said second display controller, and said flexible sheet, said switch configured to couple said second display controller to said flexible sheet in response to said sensed occurrence of said fault in said first display panel.

* * * * *